US009872597B2

(12) United States Patent
Pers et al.

(10) Patent No.: US 9,872,597 B2
(45) Date of Patent: Jan. 23, 2018

(54) DETECTING FILTER CLOGGING

(71) Applicant: ELECTROLUX HOME PRODUCTS CORPORATION N. V., Brussels (BE)

(72) Inventors: Per-Erik Pers, Järfälla (SE); Petter Svanbom, Stockholm (SE)

(73) Assignee: Electrolux Home Products Corporation N.V., Brussels (BE)

( * ) Notice: Subject to any disclaimer, the term of this patent is extended or adjusted under 35 U.S.C. 154(b) by 0 days.

(21) Appl. No.: 14/439,346

(22) PCT Filed: Nov. 8, 2012

(86) PCT No.: PCT/EP2012/072204
§ 371 (c)(1),
(2) Date: Apr. 29, 2015

(87) PCT Pub. No.: WO2014/071981
PCT Pub. Date: May 15, 2014

(65) Prior Publication Data

US 2015/0265128 A1 Sep. 24, 2015

(51) Int. Cl.

| | |
|---|---|
| ***B08B 7/04*** | (2006.01) |
| ***A47L 15/42*** | (2006.01) |
| ***A47L 15/00*** | (2006.01) |

(52) U.S. Cl.
CPC ..... *A47L 15/4202* (2013.01); *A47L 15/0049* (2013.01); *A47L 15/4208* (2013.01); *A47L 2401/08* (2013.01); *A47L 2501/26* (2013.01)

(58) Field of Classification Search
CPC ..... A47L 15/0049; A47L 15/4202; A47L 15/4208; A47L 2401/08; A47L 2501/26
USPC ..... 134/18
See application file for complete search history.

(56) References Cited

U.S. PATENT DOCUMENTS

| | | | |
|---|---|---|---|
| 4,097,307 | A | 6/1978 | Geiger |
| 5,284,523 | A | 2/1994 | Badami et al. |
| 5,330,580 | A | 7/1994 | Whipple, III et al. |
| 6,655,922 | B1 | 12/2003 | Flek |
| 6,887,318 | B2 | 5/2005 | Bashark |
| 7,064,514 | B2 | 6/2006 | Iwaji et al. |
| 7,064,517 | B2 | 6/2006 | Kiuchi et al. |
| 7,241,347 | B2 | 7/2007 | Elick et al. |
| 7,776,159 | B2 | 8/2010 | Hooker et al. |

(Continued)

FOREIGN PATENT DOCUMENTS

| | | |
|---|---|---|
| CN | 1909822 A | 2/2007 |
| DE | 197 50 266 A1 | 5/1999 |

(Continued)

OTHER PUBLICATIONS

EPO machine translation of WO2005070275 retrieved from https://worldwide.espacenet.com/publicationDetails/biblio?CC=WO&NR=2005070275A1&KC=A1&FT=D&ND=3&date=20050804&DB=&locale=en_EP on Nov. 28, 2016.*

(Continued)

*Primary Examiner* — Eric Golightly
(74) *Attorney, Agent, or Firm* — Alston & Bird LLP

(57) ABSTRACT

The present invention relates to a method of, and a device for, detecting clogging of a dishwasher filter. The device is arranged to drain the dishwasher on process water, measure operating current of a motor driving a dishwasher drain pump and determine whether the dishwasher filter is clogged based on the measured drain pump motor operating current.

9 Claims, 2 Drawing Sheets

(56) References Cited

U.S. PATENT DOCUMENTS

| | | | | |
|---|---|---|---|---|
| 7,789,968 | B2 | 9/2010 | Elick et al. | |
| 8,295,984 | B2 | 10/2012 | Heisele et al. | |
| 8,439,052 | B2 | 5/2013 | Klein | |
| 2001/0017145 | A1 | 8/2001 | Rosenbauer et al. | |
| 2003/0034749 | A1 | 2/2003 | Zinke et al. | |
| 2006/0219262 | A1 * | 10/2006 | Peterson | A47L 15/4244 134/18 |
| 2006/0237048 | A1 | 10/2006 | Weaver et al. | |
| 2007/0151579 | A1 | 7/2007 | Hooker et al. | |
| 2007/0163626 | A1 | 7/2007 | Klein | |
| 2007/0181156 | A1 | 8/2007 | Uz et al. | |
| 2010/0275953 | A1 | 11/2010 | Orue Orue et al. | |
| 2011/0038736 | A1 | 2/2011 | Hesterberg et al. | |
| 2011/0048459 | A1 | 3/2011 | Hesterberg et al. | |
| 2011/0126863 | A1 | 6/2011 | Kranzle et al. | |
| 2012/0000535 | A1 | 1/2012 | Poyner et al. | |
| 2012/0048302 | A1 | 3/2012 | Didat | |
| 2012/0060874 | A1 | 3/2012 | Gnadinger et al. | |
| 2012/0266919 | A1 | 10/2012 | Kranzle et al. | |
| 2013/0048025 | A1 | 2/2013 | Heidel et al. | |

FOREIGN PATENT DOCUMENTS

| | | | | |
|---|---|---|---|---|
| DE | 10 2004 022 682 | B3 | 3/2006 | |
| DE | 10 2007 041 313 | A1 | 3/2009 | |
| DE | 102007041313 | A1 * | 3/2009 | A47L 15/4221 |
| DE | 10 2007 052 091 | A1 | 5/2009 | |
| DE | 10 2008 020 475 | A1 | 11/2009 | |
| DE | 10 2008 029 910 | A1 | 12/2009 | |
| DE | 10 2011 000 287 | A1 | 7/2012 | |
| DE | 10 2011 003 688 | A1 | 8/2012 | |
| DE | 102011003688 | A1 * | 8/2012 | A47L 15/0023 |
| EP | 0326 893 | A2 | 8/1989 | |
| EP | 1 112 016 | A1 | 7/2001 | |
| EP | 1284540 | A2 | 2/2003 | |
| EP | 1 574 161 | A1 | 9/2005 | |
| EP | 1 737 332 | A1 | 1/2007 | |
| EP | 2213217 | | 8/2010 | |
| EP | 2 609 845 | A1 | 7/2013 | |
| EP | 2672875 | | 12/2013 | |
| JP | H 02302239 | A | 12/1990 | |
| JP | H 05 115414 | | 5/1993 | |
| JP | H 0819506 | A | 1/1996 | |
| JP | 2006 006 766 | A | 1/2006 | |
| JP | 2011 143 130 | | 7/2011 | |
| KR | 10-2012-0022427 | | 3/2012 | |
| WO | WO 2005/070275 | | 8/2005 | |
| WO | WO 2005070275 | A1 * | 8/2005 | A47L 15/0049 |
| WO | WO 2005/089621 | | 9/2005 | |
| WO | WO 2006/116433 | A1 | 11/2006 | |
| WO | WO 2008/125482 | A2 | 10/2008 | |
| WO | WO 2008125482 | A2 * | 10/2008 | A47L 15/0049 |
| WO | WO 2009/027371 | A1 | 3/2009 | |
| WO | WO 2009/068391 | A1 | 6/2009 | |
| WO | WO 2009/156326 | A2 | 12/2009 | |
| WO | WO 2012/107264 | A1 | 8/2012 | |
| WO | WO 2012/146599 | A2 | 11/2012 | |
| WO | WO 2014/005650 | A1 | 1/2014 | |

OTHER PUBLICATIONS

Office Action from corresponding European Patent Application No. 12805601.7 dated Sep. 23, 2016.

International Search Report for PCT/EP2012/072204 dated Aug. 29, 2013.

International Written Opinion for PCT/EP2012/072204 dated Sep. 6, 2013.

International Search Report and Written Opinion for International Application No. PCT/EP2012/072203, dated Sep. 6, 2013.

*Brushless DC electric motor*—Wikipedia, the free encyclopedia [online] [retrieved Nov. 19, 2013]. Retrieved from the Internet: <URL: http://en.wikipedia.org/wiki/Brushless_DC_electric_motor>. 1 page.

Office Action from U.S. Appl. No. 14/439,351 dated Apr. 21, 2017.

Office Action for U.S. Appl. No. 14/439,351 dated Aug. 18, 2017.

Office Action from corresponding European Patent Application No. 12805600.9 dated Feb. 10, 2017.

Office Action for Chinese Application No. 201280076924.9 dated Oct. 10, 2016.

* cited by examiner

DETECTING FILTER CLOGGING

CROSS REFERENCE TO RELATED APPLICATIONS

This application is a national stage application filed under 35 U.S.C. 371 of International Application No. PCT/EP2012/072204, filed Nov. 8, 2012, which is incorporated by reference herein in its entirety.

TECHNICAL FIELD

The present invention relates to a method of, and a device for, detecting clogging of a dishwasher filter.

BACKGROUND

Dishwashers comprise a filter at a bottom of a washing compartment for filtering soil from process water being recirculated in the dishwasher by means of a circulation pump. This is undertaken in order to prevent dirty process water from being recirculated and sprayed onto goods to be washed. When an excess amount of soil adheres to the filter, the filter becomes clogged and the water will ultimately not pass through the filter. It may thus be desirable to detect filter clogging such that the filter can be cleaned in order for the dishwasher to reach its full washing capability.

International patent application having publication number WO 2005/089621 discloses a dishwasher and a method of controlling the dishwasher, where effects influencing washing performance negatively such as for example filter clogging are identified by detecting current drawn by a circulation pump of the dishwasher. A disadvantage of the approach set forth in WO 2005/089621 is that detection of current drawn by the circulation pump may result in an erroneously taken decision on whether the filter is clogged or not; a reduced load on the circulation pump could just as well be a result of an insufficient amount of process water in the washing compartment of the dishwasher in which case a too small amount of process water will be circulated in the dishwasher resulting in a low process water flow through the circulation pump. Thus, the amount of current drawn by the circulation pump could indicate filter clogging when the problem in fact is that the washing compartment contains an insufficient amount of process water, which is highly undesirable.

SUMMARY

An object of the present invention is to solve, or at least mitigate this problem in the art and provide improved detection of filter clogging.

This objective is attained in a first aspect of the present invention by a device for detecting clogging of a dishwasher filter. The device is arranged to drain the dishwasher on process water, measure operating current of a motor driving a dishwasher drain pump and determine whether the dishwasher filter is clogged based on the measured drain pump motor operating current.

This object is attained in a second aspect of the present invention by a method of detecting clogging of a dishwasher filter. The method comprises the steps of draining the dishwasher on process water and measuring operating current of a motor driving the dishwasher drain pump. Further, the method comprises the step of determining that the dishwasher filter based on the measured drain pump motor operating current.

Thus, load of the drain pump is determined by measuring operating current of the motor driving the drain pump. This may easily be indirectly measured by measuring the voltage of a known shunt resistor in the motor and calculating the current by using Ohm's law. Measured current can be directly translated into drain pump torque; the higher the torque, the higher the operating current of the motor driving the pump, and a higher pump torque implies a greater flow of process water through the drain pump. Measuring drain pump motor operating current is in itself advantageous as compared to using a relatively expensive pressure sensor to measure the flow of process water through the pump. With the measured operating current, it can be determined whether the dishwasher filter is clogged. For instance, if the operating current not relatively instantly reaches a certain predetermined level upon washing compartment draining, it can be deducted that the flow of process water through the drain pump is low and that the filter is clogged.

As previously mentioned, as compared to using operating current of a circulation pump of the dishwasher for determine filter clogging, the present invention is advantageous in that in prior art filter clogging detection methods, a reduced load on a circulation pump could just as well be a result of an insufficient amount of process water in the washing compartment of the dishwasher in which case a too small amount of process water will be circulated in the dishwasher resulting in a low process water flow through the circulation pump, which has nothing to do with filter clogging. Thus, prior art filter clogging detection methods may indicate filter clogging when the problem in fact is an insufficient amount of process water in the washing compartment. With the present invention, however, a small amount of process water in the washing compartment would still cause an adequate flow of process water through the drain pump unless the filter is clogged.

In an embodiment of the present invention, which was exemplified in the above, when determining whether the dishwasher filter is clogged, the measured drain pump motor operating current is compared to a first predetermined current threshold value, wherein the filter is considered to be clogged if the measured current is below the first predetermined current threshold value. Hence, if the flow of process water is low, indicating that the filter is clogged, the drain pump load will be reduced. Thus, by appropriately setting a first current threshold value to which the measured drain pump motor operating current is compared, it can be determined whether the filter is clogged or not. In this particular embodiment, if the measured current has not reached the first threshold level relatively instantly, it is determined that the filter is clogged.

In a further embodiment of the present invention, when determining whether the dishwasher filter is clogged, the measured drain pump motor operating current is compared to a second predetermined current threshold value after a predetermined time period has expired from the start of the draining. If the measured current is above the second predetermined current threshold value after the predetermined time period has expired, the filter is considered to be clogged. Hence, if the process water still flows after an appropriately set time period has expired (albeit with a low flow rate), it can be deducted that the filter is be clogged.

In yet another embodiment, when determining whether the dishwasher filter is clogged, a number of measured drain pump motor operating current values are averaged over a predetermined averaging time period. If the resulting average operating current is below a predetermined average current threshold value, the filter is considered to be clogged. Advantageously, this particular embodiment eliminates the risk of making erroneous decisions regarding filter clogging if the water flow through the drain pump for some reason would be uneven and/or fluctuating.

By the expression "process water" as used herein, is meant a liquid containing mainly water that is used in and circulates in a dishwasher. The process water is water that may contain detergent and/or rinse aid in a varying amount. The process water may also contain soil, such as food debris or other types of solid particles, as well as dissolved liquids or compounds. Process water used in a main wash cycle is sometimes referred to as the wash liquid. Process water used in a rinse cycle is sometimes referred to as cold rinse or hot rinse depending on the temperature in the rinse cycle.

It is noted that the invention relates to all possible combinations of features recited in the claims. Further features of, and advantages with, the present invention will become apparent when studying the appended claims and the following description. Those skilled in the art realize that different features of the present invention can be combined to create embodiments other than those described in the following.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art.

Figure 1:
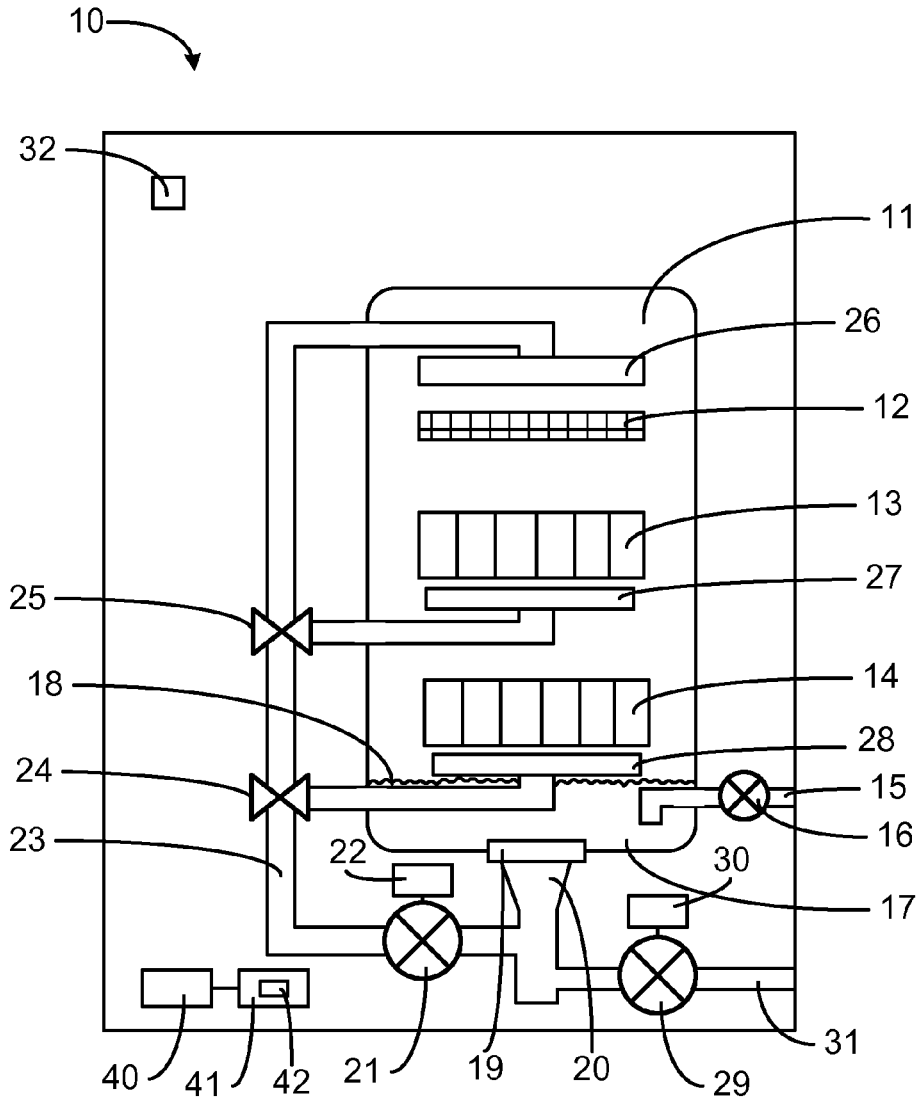
FIG. 1 shows a dishwasher in which the present invention advantageously may be applied.

FIG. 1 shows a dishwasher 10 in which the present invention can be implemented. It should be noted that dishwashers can take on many forms and include many different functionalities. The dishwasher 10 illustrated in FIG. 1 is thus used to explain different embodiments of the present invention and should only be seen as an example of a dishwasher in which the present application can be applied. The dishwasher 10 comprises a washing compartment or tub 11 housing an upper basket 12, a middle basket 13 and a lower basket 14 for accommodating goods to be washed. Typically, cutlery is accommodated in the upper basket 12, while plates, drinking-glasses, trays, etc. are placed in the middle basket 13 and the lower basket 14.

Detergent in the form of liquid, powder or tablets is dosed in a detergent compartment located on the inside of a door (not shown) of the dishwasher 10 by a user, which detergent is controllably discharged into the washing compartment 11 in accordance with a selected washing programme. The operation of the dishwasher 10 is typically controlled by processing unit 40 executing appropriate software.

Fresh water is supplied to the washing compartment 11 via water inlet 15 and water supply valve 16. This fresh water is eventually collected in a so called sump 17, where the fresh water is mixed with the discharged detergent resulting in process water 18. At the bottom of the washing compartment is a filter 19 for filtering soil from the process water before the process water leaves the compartment via process water outlet 20 for subsequent re-entry into the washing compartment 11 through circulation pump 21. Thus, the process water 18 passes the filter 19 and is pumped through the circulation pump 21, which typically is driven by a brushless direct current (BLDC) motor 22, via a conduit 23 and respective process water valves 24, 25 and sprayed into the washing compartment 11 via nozzles (not shown) of a respective wash arm 26, 27, 28 associated with each basket 12, 13, 14. Thus, the process water 18 exits the washing compartment 11 via the filter 19 and is recirculated via the circulation pump 21 and sprayed onto the goods to be washed accommodated in the respective basket via nozzles of an upper washing arm 26, middle washing arm 27 and lower washing arm 28.

Now, the filter 19 located in the sump 17 at the bottom of the washing compartment 11 is occasionally clogged due to an excess amount of soil in the processing water 18, resulting in deteriorated washing capability of the dishwasher 10. It is thus desirable to detect such clogging such that a user can clean the filter in order for the dishwasher to reach its full washing capability.

In an embodiment of the present invention, filter clogging is detected by draining the dishwasher 10 on process water 18 with a drain pump 29 driven by a BLDC motor 30. It should be noted that it can be envisaged that the drain pump 29 and the circulation pump 21 may be driven by one and the same motor. When draining the dishwasher 10, the water supply valve 16 is closed such that fresh water is prevented from entering the dishwasher. Now, when draining the dishwasher, the load of the drain pump 29 is registered. Practically, this is undertaken by measuring the operating voltage of a known shunt resistor in the motor 30 of the drain pump 29 and calculating the operating current. From the measured current, it is determined whether the filter 19 is clogged or not. For instance, as previously has been discussed, the measured drain pump motor operating current is compared to a predetermined threshold value, and it the measured current has not fallen below the predetermined threshold value within a given time expired from the start of the draining, the filter 18 is considered to be clogged. Thus, in practice, if the measured current has not fallen to a zero, or near-zero, level within a given number of seconds, water still flow through the drain pump 29, which implies that the water flow rate is low and that the filter 18 thus is clogged. If the filter is not clogged, the process water will flow freely out of drain port 31 and be drained from the dishwasher 31 within seconds and as a consequence, the motor 30 will draw little or no current.

In an embodiment of the present invention, a user of the dishwasher 10 is given an indication that the filter 19 is clogged, for example visually via a diode 32 in the dishwasher housing or audibly via a sound indication. The user may subsequently clean the filter.

The controlling of the dishwasher 10 with respect to supervising washing programmes selected by a user, controlling circulation and draining of process water 18 via the circulation pump 21 and the drain pump 29, discharging detergent, effecting rotation of wash arms 26, 27, 28, controlling actuation of water valves 16, 24, 25, etc. as well as detecting whether the filter 18 is clogged according to different embodiments of the method of the present invention is managed by the processing unit 40 via drive means such as the two BLDC motors 22, 30 and via further mechanical structures (not shown) for opening the detergent compartment, rotating the washing arms, actuating the water valves, etc. Thus, the processing unit 40 is communicatively coupled to various hardware elements in the dishwasher 10, such as the motor 30 of the drain pump 29. The processing unit 40 is typically embodied e.g. in the form of one or more microprocessors arranged to execute a computer program 42 downloaded to a suitable storage medium 41 associated with the microprocessor, such as a RAM, a Flash memory or a hard disk. The microprocessor 40 is arranged to at least partly carry out the method according to embodiments of the present invention when the appropriate computer program 42 comprising computer-executable components is downloaded to the memory 41 and executed by the microprocessor 40. The storage medium 41 may be a computer program product comprising the computer program 42. Alternatively, the computer program 42 may be transferred to the storage medium 41 by means of a suitable computer program product, such as a memory stick, or even over a network. The microprocessor 40 may alternatively be embodied in the form of an application specific integrated circuit (ASIC), a field-programmable gate array (FPGA), a complex programmable logic device (CPLD), etc.

Figure 2:
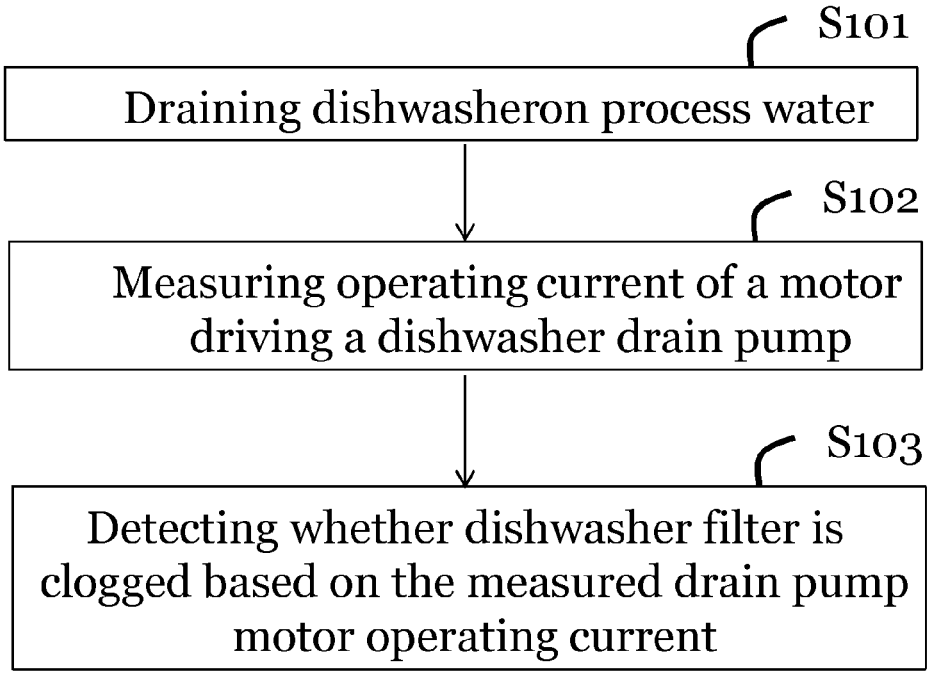
FIG. 2 shows a flowchart illustrating a method of detecting clogging of a dishwasher filter according to an embodiment of the present invention.

FIG. 2 shows a flowchart illustrating a method of detecting clogging of a dishwasher filter according to an embodiment of the present invention. In a first step S101, the processing unit 40 controls the motor 30 driving the drain pump 29 to the drain the dishwasher 10 on process water 18. Thereafter, in step S102, the processing unit 40 measures operating current of the drain pump motor 30. Finally, in step S103, the processor 40 determines whether the dishwasher filter 19 is clogged based on the measured drain pump motor 30 operating current.

In a further embodiment of the present invention, the processing unit 40 is arranged to control rotational speed of the motor 30 driving the drain pump 29 such that the rotational speed is lowered from a nominal value to a rotational speed threshold value when the dishwasher 10 is drained on process water 18. This is advantageous, since the sensitivity of the detection of the filter 19 clogging is increased. When the motor 30 for driving the drain pump 29 is running at nominal speed, say about 3000 rpm, which typically is the rotational speed used for draining the dishwasher during a normal washing cycle, it is less likely that air is detected in the drain pump, which indicates filter clogging. By lowering the rotational speed of the motor 30 down to about 1800 rpm, changes in drain pump motor operating current are easier to detect, and the processing unit 40 can determine with higher accuracy whether the filter 19 is clogged or not.

It should be noted that the filter clogging detection undertaken according to embodiments of the present invention generally is a part of a normal washing cycle of the dishwasher. Typically, the filter clogging detection method according to embodiments of the present invention is applied at the end of a washing cycle when the dishwasher is drained on process water having the advantage that no fresh water must be supplied to the dishwasher for the washing cycle to continue after filter clogging detection. However, the filter clogging detection method according to embodiments of the present invention could be applied during a normal washing cycle if for some reasons indications are given that the filter is clogged. It may even be envisaged that a separate short filter clogging detection program is run to test whether the filter of the dishwasher is clogged.

Even though the invention has been described with reference to specific exemplifying embodiments thereof, many different alterations, modifications and the like will become apparent for those skilled in the art. The described embodiments are therefore not intended to limit the scope of the invention, as defined by the appended claims.

The invention claimed is:

1. A method of detecting clogging of a dishwasher filter, comprising the steps of:

draining the dishwasher on process water;

measuring operating current of a motor driving a dishwasher drain pump; and determining whether the dishwasher filter is clogged based on the measured drain pump motor operating current, wherein the step of determining whether the dishwasher filter is clogged based on the measured drain pump motor operating current comprises comparing the measured drain pump motor operating current to a first predetermined current threshold value, wherein the filter is considered to be clogged if the measured current is below the first predetermined current threshold value.

2. The method of claim 1, further comprising the step of:

comparing the measured drain pump motor operating current to a second predetermined current threshold value when a predetermined time period has expired from the start of the draining, wherein the filter is considered to be clogged if the measured current is above the second predetermined current threshold value after the predetermined time period has expired.

3. The method of claim 1, further comprising the step of:

averaging a number of measured drain pump motor operating current values over a predetermined averaging time period, wherein the filter is considered to be clogged if the average operating current is below a predetermined average current threshold value.

4. The method of claim 1, further comprising the step of:

signaling, via an indicator of the dish washer, that the filter is clogged.

5. The method of claim 1, further comprising the step of:

controlling rotational speed of the motor driving the drain pump such that the rotational speed is lowered from a first value to a second value when the dishwasher is drained on process water.

6. A computer program comprising computer-executable components for causing a device to perform the steps recited in claim 1 when the computer-executable components are run on a processing unit included in the device.

7. A computer program product comprising a computer readable medium, the computer readable medium having the computer program according to claim 6 embodied therein.

8. The method of claim 1, wherein the dishwasher drain pump is disposed downstream of the filter.

9. The method of claim 1, wherein comparing the measured drain pump motor operating current to the first predetermined current threshold value occurs instantly.

* * * * *